United States Patent [19]

Clark

[11] Patent Number: 4,765,405

[45] Date of Patent: Aug. 23, 1988

[54] PERFORATION CIRCULATING WASHER

[76] Inventor: William R. Clark, Box 1639, Riverton, Wyo. 82501

[21] Appl. No.: 25,348

[22] Filed: Mar. 13, 1987

[51] Int. Cl.[4] ..... E21B 33/124; E21B 33/126; E21B 37/08

[52] U.S. Cl. ..... 166/186; 166/191

[58] Field of Search ..... 166/186, 191, 202, 157, 166/158, 312

[56] References Cited

U.S. PATENT DOCUMENTS

| | | | |
|---|---|---|---|
| 2,239,296 | 4/1941 | Robinson | 166/186 X |
| 2,274,756 | 3/1942 | Travers, Jr. | 166/186 X |
| 2,308,072 | 1/1943 | Granger | 166/186 X |
| 2,360,311 | 10/1944 | Ausburn et al. | 166/186 X |
| 2,426,164 | 8/1947 | Breukelman | 166/186 X |
| 3,396,798 | 8/1968 | Burns et al. | 166/186 X |

*Primary Examiner*—Stephen J. Novosad
*Attorney, Agent, or Firm*—Lewis E. Massie

[57] ABSTRACT

Disclosed is an improved tool for washing the perforations in an oil or gas well bore casing. The tool includes a tubular mandrel having orifices, between pairs of pressure sealing packer cups, for discharging a cleaning fluid into the area between the tool and the casing. The longitudinal spacing between the packer cups is variable by means of variable length spacer sleeves placed between the packer cups. The mandrel having an axial internal by-pass tube for passing cleaning fluid and debris through the mandrel. The by-pass tube having a telescoping section for accommodating the elongation and contraction of the tube due to temperature changes. The by-pass tube also permits entering the tool into the casing by eliminating vacuum or pressure build-up in the casing.

4 Claims, 2 Drawing Sheets

PERFORATION CIRCULATING WASHER

FIELD OF THE INVENTION

It is common to set steel casing in the bore of oil and gas walls. The casing is perforated at the levels matching deposits of oil and water to be extracted from the surrounding formations. These perforations can become clogged with gravel and sand, thus diminishing the flow of oil,or water, through the perforations. It is necessary to periodically clean the perforations to maintain the maximum flow of oil or water.

Cleaning the perforations is accomplished by tools fastened to the tool string and lowered into the well casing. In general the cleaning tools consist of a cylindrical mandrel having radial packer cups to seal off the space between the tool and the casing. Perforations in the tubular mandrel between the packer cups allows presurized cleaning fluid to enter the sealed off space. The tool is placed into the casing so as to expose the casing perforations to the cleaning fluid.

DESCRIPTION OF THE PRIOR ART

A review of the prior art discloses several tools designed specifically for washing well perforations; however, none of the prior art discloses the advantages of the present invention. Most notable inventions described in the prior art are: U.S. Pat. No. 4,484,625 Barbee which discloses a tubular mandrel having a flow passage sealed off by expandable packer cups which are expanded against the casing by pistons operated by the pressurized cleaning fluid. U.S. Pat. No. 2,935,132 Atterbury which discloses a casing sealed off at the top of the well to force the cleaning fluid to enter the mandrel at the bottom. A packer ring at the top of the tool mandrel forces the cleaning fluid through the perforations. U.S. Pat. No. 4,027,732 Perkins which discloses an outer housing and inner mandrel with fluid passage therebetween. Valves are shown for either pumping cleaning fluid down the casing or the tool string.

SUMMARY OF THE INVENTION

The present invention describes an improved tool of simplified construction for washing the perforations over a selected length of the casing.

The perforation washing tool comprises principally a tubular mandrel threadably fastened to the dril string on the top end with the bottom end threadably fasened to a flow blocking valve. Two radially expandable vertical spaced packer cups in close engagement with the casing wall above and below the casing perforations to be washed define the section wherein the pressurized cleaning fluid will be introduced.

The vertical spacing between the upper packing cups and the vertical spacing between the lower packing cups is determined by spacing sleeves slidably mounted on the mandrel. It is an object of the present invention to accommodate the various lengths of working sections required for specific wells by introducing spacing sleeves of various lengths. Prior to the present invention mandrels were customized to suit the requirements for tools of different lengths.

Another object of the present invention is an axial by-pass tube internal to the mandrel with means for absorbing the longitudinal expansion and contraction due to temperature and working stresses. The by-pass tube, in addition to providing a passage through the wash tool, prevents the build up of vacuum and pressure when entering the tool into the well casing.

The innovative arrangement of a mandrel with provisions for adjusting the working area coupled with an internal by-pass tube allows the introduction of cleaning fluid under pressure into the top of the drill string and down the drill string into the tool mandrel. The pressurized cleaning fluid then exits the mandrel into the preselected area of the well casing. After passing through the casing perforations the cleaning fluid together with the debris then flows downward, or upward, to reenter the casing for discharge at the top of the well.

DESCRIPTION OF THE PREFERRED EMBODIMENT

Figure 1:
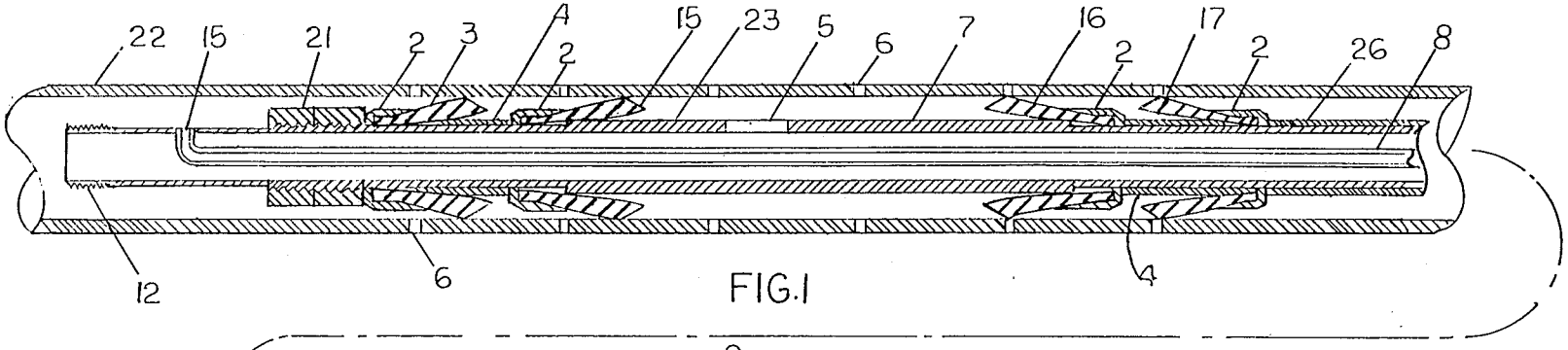
FIG. 1 is a left side longitudinal sectional view of the bottom section of the perforation washing tool inserted into the well casing.
Figure 2:
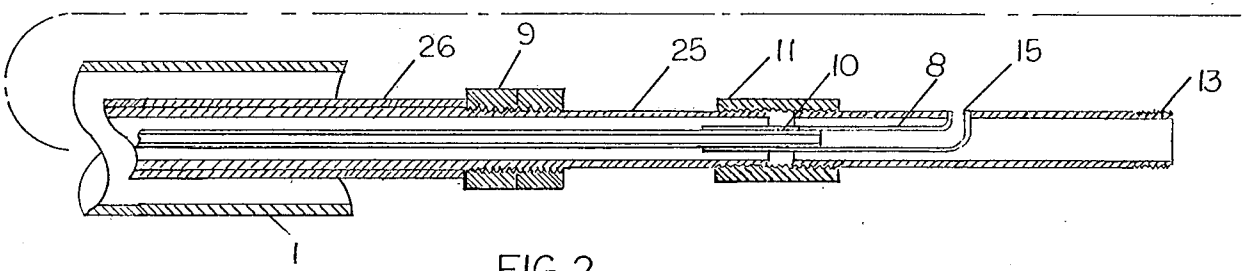
FIG. 2 is a left side longitudinal sectional view of the upper section of the perforation washing tool inserted into the well casing.
Figure 3:
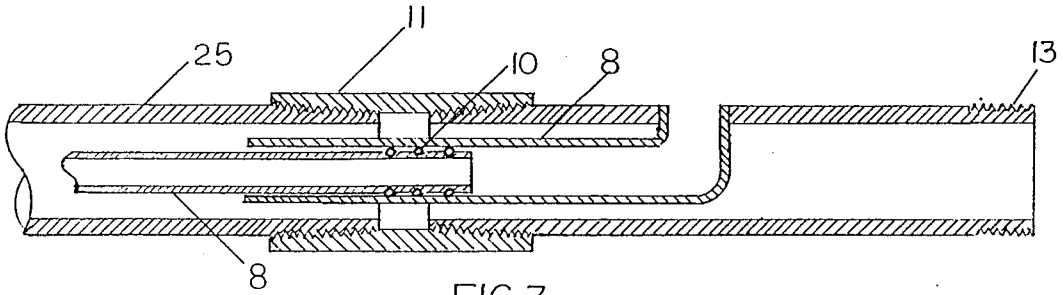
FIG. 3 is an enlarged left side sectional view of the bypass tube expansion joint.
Figure 4:
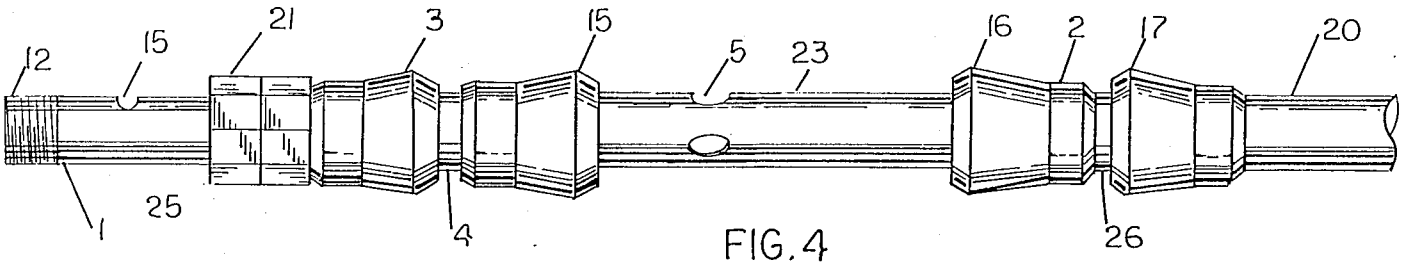
FIG. 4 is a left side longitudinal view of the bottom section of the washing tool.
Figure 5:
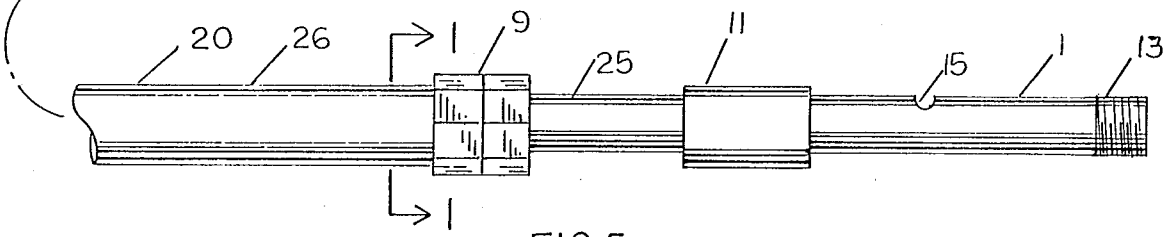
FIG. 5 is a left side longitudinal view of the top section of the washing tool.
Figure 6:
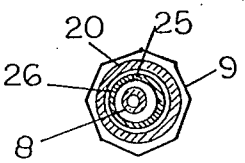
FIG. 6 is a sectional view 1—1 of FIG. 5.
Figure 7:
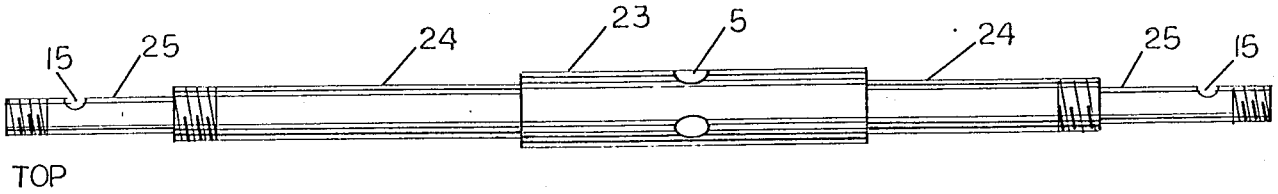
FIG. 7 is a right side elevation of the mandrel.
Figure 8:
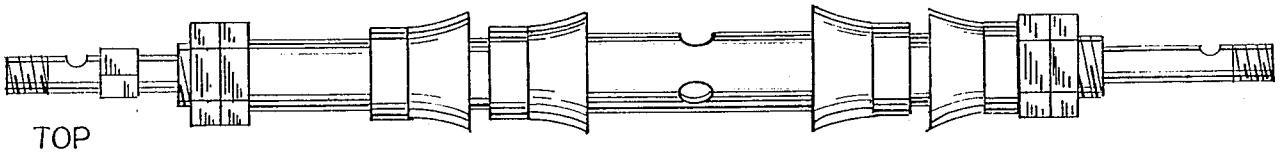
FIG. 8 is a right side elevation of the washing tool.

With reference to FIG. 1 and FIG. 2 there is shown a wash tool 1 embodying the present invention disposed in operative position in a well casing 22 having perforations 6 in the side wall. The perforations having different longitudinal spacings particular to a given well.

The tool comprises a tubular mandrel 7 having a maximum outside diameter in the center section 23. Abutting the center section 23 on each end is a section of reduced ouside diameter 24. The reduced section 24 being threaded ont he lower end. A section of still further reduced diameter 25 on each end of the tool terminates the tool length. Openings 15 near the end of the tool provide exits for the internal by-pass tube 8.

Axially disposed in the tool 7 is the by-pass tube 8 extending substantially the entire length of the tool 7, the bypass tube having means 10 & 11 to accommodate the changes in length due to temperature and working stresses.

Pliable, compressible, radially expandable packing cups 3, 15, 16, mounted on metal rings 2 are slidably mounted on the sections 24 abutting the center section 23 of the tool 7. The innermost packing cups 15, 16 are positioned by section 23. The center section 23 of the tool 7 having a plurality of exit holes 5 for the flow of the cleaning fluid.

The spacing between the innermost packing cups 15, 16, is determined by the length of the spacing sleeves 4, 26. Packing cup 3 is held in compression by lock nut 21. Packing cup 17 is held in compression against sleeve 20 by lock nut 9.

I claim:

1. An oil well casing perforation cleaning tool having a tubular mandrel connected at its upper end to the lower end of a well pipe string for passage of cleaning fluid, the lower end of the tool being closed, a plurality of openings central to the tool sealed to the well casing by packer cups each side of the openings wherein the improvement comprises:

a, a pair of radially expandable packer cups mounted on said mandrel between the tool and the well casing;

b, means for adjusting the longitudinal spacing between the packer cups;

c, an axial internal by-pass tube extending substantially the length of the tool;

d, an opening in each end section of said tool in fluid communication with with said internal by-pass tube; and, e, external threads on the terminating ends of the tool.

2. In an oil well casing perforation cleaning tool as described in claim 1 wherein the improvement comprises:

a, the by-pass tube having a telescoping section; and, b, the internal section of the telescoping section sealed to the external section by circumferential "O" rings.

3. In an oil well casing perforation cleaning tool as described in claim 1 wherein the improvement comprises:

a, the internal by-pass tube connected to top tubular mandrel exit by telescoping joint;

b, telescoping joint accomplished by main by-pass tube slidably connected into exit portion of by-pass tube;

c, circumferential O-rings sealing the interface between the tubes; and, d, longitudinal thermal expansion, or contraction, by either the by-pass tube or the tubular mandrel being slidably accomodated.

4. In an oil well casing perforation cleaning tool as described in claim 1 wherein the improvement comprises:

a, the tool mandrel consisting of five longitudinal sections of different outside diameters;

b, the central section of the mandrel having the largest outside diameter;

c, the central section having a plurality of openings in the side wall;

d, a packer cup mounting section with an outside diameter less than the outside diameter of said central section abutting each end of said central section;

e, two packer cups fastened on each of said of metal rings slidably mounted to packer cup mounting sections;

f, metal spacing sleeves slidably mounted on each of said packer cup mounting sections for establishing spacing between said packer cups; and, g, packing cups with spacing sleeves fastened to tool by locknuts threadably secured on said mandrel for fastening said packer cups and spacing sleeves to said tool.

* * * * *